United States Patent [19]

Roe

[11] 4,115,155

[45] Sep. 19, 1978

[54] LOW CARBON HIGH YIELD AND TENSILE STRENGTH STEEL AND METHOD OF MANUFACTURE

[75] Inventor: Gerald J. Roe, Bethlehem, Pa.

[73] Assignee: Bethlehem Steel Corporation, Bethlehem, Pa.

[21] Appl. No.: 766,838

[22] Filed: Feb. 7, 1977

Related U.S. Application Data

[63] Continuation-in-part of Ser. No. 651,662, Jan. 22, 1976, abandoned, which is a continuation-in-part of Ser. No. 466,760, May 3, 1974, abandoned.

[51] Int. Cl.[2] ..... C21D 7/14

[52] U.S. Cl. ..... 148/12 F; 75/123 R; 75/123 B; 75/123 J; 148/36

[58] Field of Search ..... 75/123 R, 123 B, 123 J, 75/123 M, 124; 148/12 F, 36, 12.1, 12.3, 12.4, 12.7

[56] References Cited

U.S. PATENT DOCUMENTS

| | | | |
|---|---|---|---|
| 2,280,283 | 4/1942 | Crafts | 75/123 |
| 2,542,220 | 2/1951 | Urban et al. | 75/124 X |
| 2,772,154 | 11/1956 | Morgan et al. | 75/123 |
| 3,010,822 | 11/1961 | Attenberger et al. | 75/123 |
| 3,102,831 | 9/1963 | Tisdale | 148/12 |
| 3,544,393 | 12/1970 | Zanetti | 148/12 F |
| 3,592,633 | 7/1971 | Osuka et al. | 75/124 X |
| 3,619,303 | 11/1972 | Semel | 148/36 X |
| 3,645,801 | 2/1972 | Melloy | 148/12 F |
| 3,676,108 | 7/1972 | McGarrity | 75/123 B |
| 3,725,049 | 4/1973 | Satoh et al. | 148/36 |
| 3,918,999 | 11/1975 | Sekine et al. | 148/12 F |
| 3,925,111 | 12/1975 | Takechi et al. | 148/12 F |
| 4,043,807 | 8/1977 | Kirman | 75/123 B |

FOREIGN PATENT DOCUMENTS

| | | | |
|---|---|---|---|
| 874,406 | 6/1971 | Canada | 148/36 |
| 830,669 | 3/1960 | United Kingdom | 75/123 B |
| 1,058,146 | 2/1967 | United Kingdom | 148/36 |
| 1,195,002 | 6/1970 | United Kingdom | 148/36 |

*Primary Examiner*—R. Dean
*Assistant Examiner*—Michael L. Lewis
*Attorney, Agent, or Firm*—Joseph J. O'Keefe; John J. Selko

[57] ABSTRACT

A process for producing a killed, low carbon, columbium, boron alloy steel characterized by high strength and an unbanded ferrous microstructure in the as-rolled condition. The steel is hot rolled to form an intermediate section before the steel temperature reaches 1650° F. Below 1650° F, the steel is further reduced with a total minimum reduction of 50% in one embodiment, and 35% in a second embodiment, and in the $Ar_3$–$Ar_1$ temperature range, reduction is a plurality of reduction passes under conditions to permit substantial recrystallization of deformed grains after each pass, with a finishing temperature between 1100°–1150° F in one embodiment, and a finishing temperature between 1350° F and $Ar_1$ in a second embodiment.

6 Claims, 3 Drawing Figures

LOW CARBON HIGH YIELD AND TENSILE STRENGTH STEEL AND METHOD OF MANUFACTURE

CROSS-REFERENCE TO RELATED APPLICATION

This application is a continuation-in-part of copending continuation-in-part application Ser. No. 651,662 filed Jan. 22, 1976 which is a continuation-in-part of application Ser. No. 466,760, filed May 3, 1974, both now abandoned.

BACKGROUND OF THE INVENTION

Low carbon high strength steels which exhibit a minimum yield strength of 75,000 psi, and/or a minimum tensile strength of 85,000 psi. together with acceptable ductility are increasingly in demand.

Some prior art steels require heating, quenching, and tempering treatments subsequent to rolling before they can exhibit such properties. Such treatments are undesirable from the standpoint of cost and efficiency.

Some prior art steels which can exhibit high as-rolled strength require the presence of at least 0.07 weight percent of carbon plus other strengthening agents such as chromium.

One such low carbon high strength steel and its method of manufacture is found in U.S. Pat. Nos. 3,689,259 and 3,544,393 issued to Joseph R. Zanetti on Sept. 5, 1972 and Dec. 1, 1970, respectively. The steel disclosed in these patents requires at least 0.07 weight percent of carbon plus chromium, columbium, boron and zirconium strengthening agents. Unless otherwise noted, all composition percentages hereinafter are weight percent. Each additional strengthening agent adds to the cost of such steel, especially chromium which is becoming increasingly difficult to obtain.

There is a need therefore for a low carbon steel, having not more than 0.07% carbon, which steel exhibits in the as-rolled condition high yield and tensile strength plus acceptable ductility and toughness with a minimum of strengthening agents and preferably with no chromium. There is also a need for a method for producing such steels.

SUMMARY OF THE INVENTION

I have discovered that I can provide an as-rolled low carbon high yield and tensile strength steel with an unbanded ferrous microstructure by a critical combination of composition and process wherein the composition consists essentially of the following weight percentages:

| | Percent, about |
|---|---|
| Carbon | .04–.07 |
| Manganese | 1.00–1.60 |
| Sulfur | .015 max. |
| Columbium | .10 max. |
| Boron | .0005–.004 |
| Silicon | .40 max. |
| Aluminum | .02 min. |
| Titanium | 0.–.03 max. |
| Vanadium | 0.–.10 max. |

the balance being iron with residual impurities such as are ordinarily encountered in conventional basic oxygen, open hearth, or electric furnaces used in producing steel. The maximum desirable values of the most common residual impurities are:

| | Percent, Max. |
|---|---|
| Phosphorus | .040 |
| Copper | .10 |
| Tin | .06 |

The upper limit of carbon is ordinarily not exceeded, and the lower limit can go to about 0.04%, resulting in the maintenance of acceptable impact properties, while at the same time the yield and tensile strengths are not deteriorated due to the low carbon because of the combination of composition and process.

The manganese is added to the furnace or ladle. Preferably, the manganese is maintained in the range of 1.00 to 1.60% with a range of 1.36 to 1.42% being desired.

Sulfur is preferred below 0.015% maximum for impact properties.

Columbium can be present up to 0.10% maximum with a preferred amount around 0.02 to 0.04%.

Boron is added to the ladle and contributes to the improved strength of the low carbon alloys. A preferred amount for boron is around 0.002% but an acceptable range is 0.0005 to 0.004% maximum.

Silicon acts as a deoxidizer, and is preferred up to 0.40% maximum, with a minimum of 0.15%.

Aluminum is preferred as 0.02% minimum and a maximum of 0.1% to insure in combination with the silicon that the steel is adequately fully killed. Aluminum is added to the ladle, as is well known. The steel of this invention is, therefore, a silicon-aluminum killed steel.

Titanium is optional and is added to the ladle to protect the boron because of titanium's greater affinity for oxygen and nitrogen. A maximum of 0.03% is preferred, with a minimum of 0.01%.

Vanadium is optional, being absent in one alloy and present in another. When added, vanadium can be present in an amount 0.01 to 0.10% with a preferred amount around 0.05%.

In critical combination with the above composition, the process of this invention results in improved properties, in one embodiment, wherein a total minimum reduction of about 50% takes place below 1650° F. with a finishing temperature between 1150° F. and 1100° F., and reduction in the $Ar_3$–$Ar_1$ temperature range comprises a plurality of small reduction passes under conditions to permit substantially complete recrystallization of deformed grains after each pass, and reduction below the $Ar_1$ temperature is limited to a maximum of about 15%.

Another embodiment results in improved properties wherein a total minimum reduction of about 35% takes place below 1650° F., with a finishing temperature between 1350° F. and the $Ar_1$ temperature, and reduction in the $Ar_3$–$Ar_1$ temperature range comprises a plurality of small reduction passes under conditions to permit substantially complete recrystallization of deformed grains after each pass, and there is no reduction below the $Ar_1$ temperature.

DETAILED DESCRIPTION OF PREFERRED EMBODIMENT

The embodiments of this invention are disclosed in the representative data listed in the examples below:

EXAMPLE I

Table I shows the weight percent heat analysis of the preferred low carbon, columbium, boron alloy of this invention, listed as Cb4. An alternate alloy containing, in addition, vanadium is listed as CbVI.

TABLE I

| | Sample Cb4 | Sample CbVI |
|---|---|---|
| C | .067 | .040 |
| Mn | 1.42 | 1.36 |
| P | .008 | .010 |
| S | .005 | .005 |
| Si | .27 | .26 |
| Cb | .033 | .022 |
| B | .002 | .002 |
| V | .003 | .053 |
| Ti | .021 | .023 |
| Al | .063 | .056 |

For both alloys, Cb4 and CbVI, and $Ar_3$ and $Ar_1$ were determined for a cooling rate of approximately 1000° F./hr to be: Cb4–$Ar_3$ 1454° F. and $Ar_1$ 1249° F.; CbVI–$Ar_3$ 1462° F. and $Ar_1$ 1208° F.

Slabs were provided from heats with the above analyses and rolled to one-half inch plate on a reversing mill according to the following preferred procedure, which is referred to as control rolling.

The slabs were heat soaked (austenitized) at a temperature between 2200° F. and 2300° F. An intermediate section was produced by rolling the slabs to reduce their gage to an intermediate gage, before the slab temperature fell below about 1650° F.

It should be understood that should the intermediate section be reached while the slab temperature is significantly above about 1650° F., the intermediate sections are allowed to cool to approximately 1650° F. before final reduction takes place. It should be further understood that the 1650° F. can vary a slight amount plus or minus, 50° F.

Figure 1:
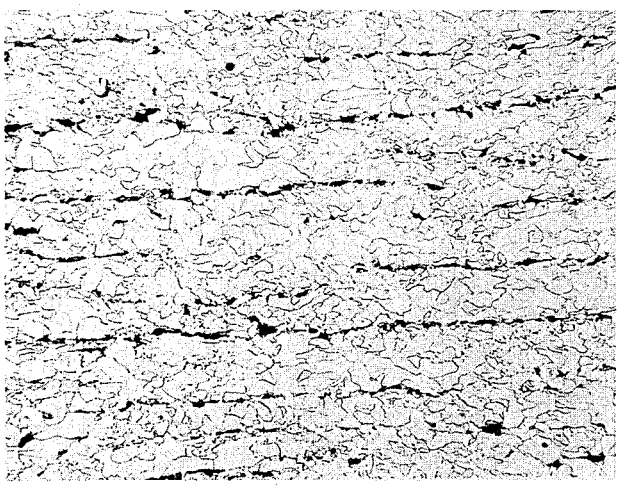
FIG. 1 shows the banded microstructure of a plate produced by conventional prior art hot rolling, viewed parallel to the rolling direction and perpendicular to the plate surface at 200X.
Figure 3:
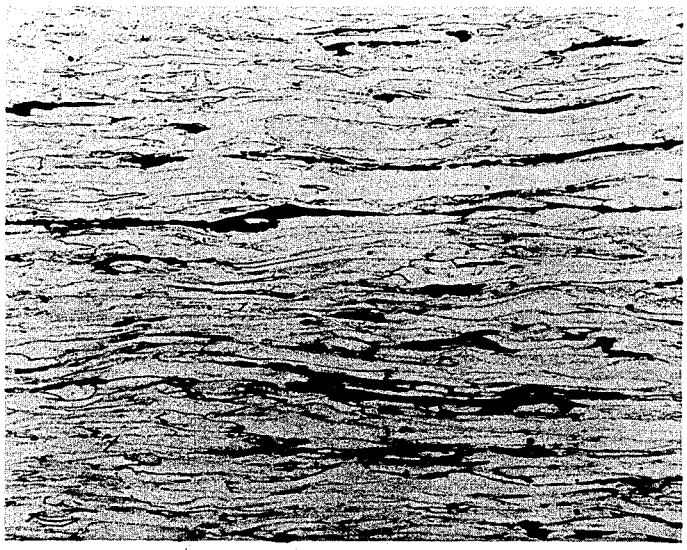
FIG. 3 shows the banded microstructure of a plate rolled by Continuum Rolling, viewed parallel to the rolling direction and perpendicular to the plate surface at 200X.

After the intermediate section reached a temperature of approximately 1650° F., the intermediate section was further reduced to its final gage. Such final reduction took place below about 1650° F. At 1650° F., which is above the $Ar_3$ temperature, the steel is austenitic; below the $Ar_3$ temperature the steel begins its austenite to ferrite transformation. Below the $Ar_1$ temperature the steel is ferrite and pearlite and lower transformation products, therefore, the final reduction of the intermediate section begins while the steel is above the $Ar_3$ and continues while the steel temperature is between the $Ar_3$ and $Ar_1$. Furthermore, while the steel is between the $Ar_3$–$Ar_1$ temperature, reduction comprises a plurality of small reduction passes. By small reduction pass, I mean that the percentage reduction of cross section in each pass is less than about 12 percent. In addition, conditions are maintained such that after each reduction pass in the $Ar_3$–$Ar_1$ temperature range substantially all the deformed crystals of austenite, or its transformation product, i.e., ferrite/pearlite, are recrystallized. By recrystallizing deformed grains after each reduction pass, it is possible to avoid producing a banded structure in the final product. By banded structure I mean a structure, which when viewed parallel to the rolling direction and perpendicular to the plate surface has colonies of pearlite elongated in the rolling direction and ferrite surrounding the pearlite colonies, giving the structure an overall striped appearance as shown in FIG. 1. A more severe banded structure is shown in FIG. 3 where both pearlite colonies and ferrite grains are severely elongated in the rolling direction.

Figure 2:
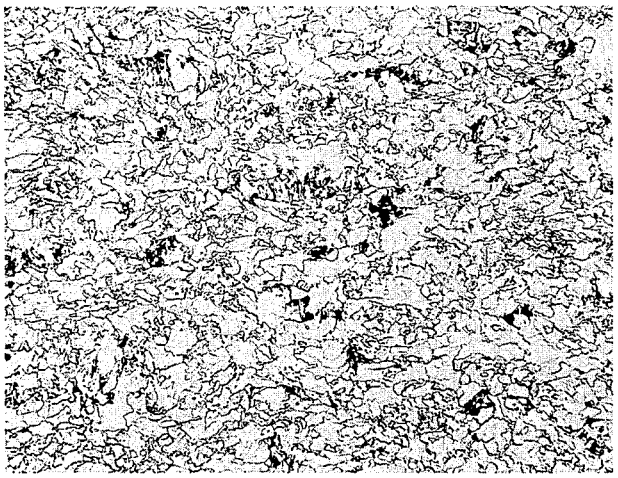
FIG. 2 shows the unbanded microstructure of a plate of the invention viewed parallel to the rolling direction and perpendicular to the plate surface at 200X.

One method of determining if complete recrystallization has occured during rolling is to examine the final product microstructure. The absence of a banded ferrite-pearlite structure, such as shown in FIG. 2, demonstrates complete recrystallization has taken place during product rolling.

One method to assure recrystallization after each reduction pass is to make sure that the steel temperature after each pass is above the temperature at which 100% recrystallization takes place. Such 100% recrystallization temperature can be determined by well known means. Another way is to maintain the steel within the $Ar_3$–$Ar_1$ temperature range between passes until substantially complete recrystallization takes place, before effecting the next reduction pass.

Reduction of the intermediate section continues below the $Ar_1$ temperature down to the finishing temperature of 1100°–1150° F., but total percent reduction is limited to about 15% to avoid a banded structure in the final product. The plates were permitted to cool in air without forced cooling.

It should be understood that the selection of the intermediate section thickness is governed in each case by the requirement that the total amount of reduction performed on the intermediate section between the intermediate and final gage is at least 50%, if a yield strength in excess of 75,000 psi. is desired. A smaller percentage reduction might not provide the desired strength level. Because a significant amount of reduction takes place below about 1650° F., the recrystallization of grains and grain growth is sluggish due to the low temperature, and the final product is fine grained, which condition, along with the reduction, enhances the mechanical properties as hereinafter described.

Table II summarizes the preferred embodiment of the rolling procedure:

TABLE II

| | Mill Gage Inches | | Temperature ° F | | Total % Reduction Below 1650° F | |
|---|---|---|---|---|---|---|
| | Cb4 | CbVI | Cb4 | CbVI | Cb4 | CbVI |
| Slab | 3.50 | 3.50 | 1970 | 2000 | — | — |
| Intermediate Section | 1.20 | 1.20 | 1665 | 1670 | — | — |
| Final Section | .50 | .50 | 1140 | 1100 | 58 | 58 |

Table II-A summarizes in greater detail the rolling procedure used for reduction within the $Ar_3$–$Ar_1$ temperature range and below the $Ar_1$ to finishing temperature. Between each pass in the $Ar_3$–$Ar_1$ temperature range, the steel was held to permit the temperature to drop and substantially complete recrystallization to occur before the next pass was made. Therefore, at each gage shown, the temperature is the steel temperature at the time reduction to that gage is started. Such rolling procedure differs from rolling referred to as "Continuum Rolling" and exemplified by U.S. Pat. No. 3,645,801 to Melloy et al. in that "Continuum Rolling" requires that when multiple reduction passes are made within the $Ar_3$–$Ar_1$ range, they are performed so rapidly that substantially complete recrystallization does not occur between passes and leads to a banded ferrite-pearlite microstructure. In addition the "continuum rolled" ferrite grains are severely elongated in the rolling direction, FIG. 3, a condition which indicates substantial deformation of unrecrystallized grains.

TABLE II-A

| Mill Gage Inches | Cb4 Temperature ° F | Cb4 % Reduction | CbVI Temperature ° F | CbVI % Reduction |
|---|---|---|---|---|
| 1.20 | 1665 | 14.3 | 1670 | 14.3 |
| 1.07 | 1630 | 10.8 | 1625 | 10.8 |
| .97 | 1570 | 9.3 | 1570 | 9.3 |
| .88 | 1540 | 9.3 | 1530 | 9.3 |
| .80 | 1470 | 9.1 | 1470 | 9.1 |
| | —1454° F, $Ar_3$— | | —1462° F, $Ar_3$— | |
| .73 | 1450 | 8.8 | 1450 | 8.8 |
| .68 | 1370 | 6.9 | 1370 | 6.9 |
| .63 | 1330 | 7.4 | 1335 | 7.4 |
| .59 | 1270 | 6.4 | 1270 | 6.4 |
| | —1249° F, $Ar_1$— | | — | — |
| .56 | 1235 | 5.1 | 1245 | 5.1 |
| — | — | — | —1208° F, $Ar_1$— | |
| .53 | 1170 | 5.4 | 1180 | 5.4 |
| .50 | 1140 | 5.7 | 1100 | 5.7 |

The as-rolled mechanical and impact properties of the controlled-rolled alloy are shown in Table III. Tensile tests were performed on flat, full thickness threaded samples.

TABLE III

| | Mechanical (Transverse) Y.S.* (ksi.) | T.S. (ksi.) | % El. in 2 in. | % R.A. | Impact (Transverse) 2/3 Size Charpy Cv10 Ft. -Lbs.T.T. |
|---|---|---|---|---|---|
| Cb4 | 78.9 | 91.3 | 23.0 | 53.7 | −90° F |
| CbVI | 81.6 | 92.0 | 22.0 | 64.0 | −58° F |

*−.2% offset

Table III illustrates that the preferred combination of treatment and composition results in a controlled-rolled alloy possessing a yield strength well in excess of 75,000 psi. and a tensile strength in excess of 90,000 psi. while at the same time combining acceptable ductility and impact strength in the as-rolled condition. An alternate controlled-rolled alloy, CbVI, likewise exhibits similar properties.

The metallographic structure of such alloys, when viewed parallel to the rolling direction and perpendicular to the plate surface, was found to be an unbanded mixture of ferrite, extremely fine pearlite, and some lower transformation products such as bainite and martensite. The typical as-rolled banding of pearlite was unexpectedly broken up into smaller, dispersed patches, a result of the columbium and boron in the composition in combination with the processing. The ferrite, pearlite, and lower transformation products are not banded, i.e., have no elongation in the rolling direction, nor striped pattern of pearlite and ferrite phases. FIG. 2 shows the microstructure of a plate of the inventive composition-process combination. FIG. 1 shows the microstructure of a prior art plate conventionally hot rolled. Both plates were rolled with a finishing temperature of 1100° F. The prior art plate had a carbon and columbium content similar to the inventive composition, but had no boron; the prior art composition was not able to resist banding of the ferrite and pearlite phases.

FIG. 3 shows the microstructure of a steel rolled by "Continuum Rolling." The pearlite-ferrite structure is severely banded in the rolling direction. The ferrite grains have been elongated in the rolling direction because of a severe deformation of unrecrystallized ferrite grains. The steel of FIG. 3 was similar in analysis to the inventive steel except the "Continuum Rolled" steel had no boron. As is well known, an unbanded structure would improve transverse properties, especially ductility, and impact properties of the alloy. The grain size was found to be greater than ASTM Number 7, which makes it fine grained.

EXAMPLE II

Additional slabs were provided from the heats listed in Table I and rolled to produce an intermediate section, as described in Example I.

Final reduction from intermediate to final gage was performed to provide at least 35% total minimum reduction on the intermediate section, with a finishing temperature between approximately 1350° F. and 1300° F. The microstructure of the steel of this Example II is similar at various stages of the processing to that of Example I.

Table IV summarizes the rolling practice.

TABLE IV

| | Mill Gage Inches Cb4 | Mill Gage Inches CbV1 | Temperature ° F. Cb4 | Temperature ° F. CbV1 | Total % Reduction Below 1650° F Cb4 | Total % Reduction Below 1650° F CbV1 |
|---|---|---|---|---|---|---|
| Slab | 3.50 | 3.50 | 2040 | 2000 | — | — |
| Intermediate Section | .78 | .78 | 1640 | 1680 | — | — |
| Final Section | .50 | .50 | 1320 | 1300 | 36 | 36 |

Table IV-A summarizes in greater detail the rolling procedure used for reduction within the $Ar_3$–$Ar_1$ temperature range. As in Example I, reduction comprised a plurality of small reduction passes of less than about 12%. Conditions were maintained such that after each reduction pass in the $Ar_3$–$Ar_1$ temperature range, substantially all the deformed crystals of austenite, or its transformation product, i.e., ferrite/pearlite are recrystallized. Reduction is completed between 1350° F. and the $Ar_1$ temperature. No reduction takes place below $Ar_1$. This procedure in combination with the composition assures an unbanded structure in the final product.

TABLE IV-A

| Mill Gage Inches | Cb4 Temperature ° F | Cb4 % Reduction | CbVI Temperature ° F | CbVI % Reduction |
|---|---|---|---|---|
| .78 | 1640 | 15.2 | 1680 | 15.2 |
| .71 | 1630 | 9.0 | 1650 | 9.0 |
| .64 | 1500 | 9.9 | 1600 | 9.9 |
| .57 | 1460 | 10.9 | 1490 | 10.9 |
| | —1454° F, $Ar_3$— | | —1462° F, $Ar_3$— | |
| .53 | 1430 | 7.0 | 1410 | 7.0 |
| .50 | 1320 | 5.7 | 1300 | 5.7 |

The as-rolled mechanical and impact properties of the alternate embodiment rolling practice of the controlled-rolled alloy and an alternate alloy are shown in Table V. As in Example I, tensile tests were performed on flat, full thickness threaded samples.

TABLE V

| | Mechanical (Transverse) | | | | Impact (Transverse) |
|---|---|---|---|---|---|
| | * Y.S. (ksi) | T.S. (ksi) | % El. in 2 In. | % R.A. | 2/3 Size Charpy Cv10 Ft.-Lbs. T.T. |
| Cb4 | 70.8 | 85.9 | 27.8 | 64.5 | −115° F |
| CbV1 | 63.8 | 85.0 | 27.7 | 68.4 | −90° F |

*−.2% Offset

Table V illustrates that the combination of treatment and composition results in a controlled-rolled alloy and an alternate alloy possessing a tensile strength of 85,000 psi. and higher while at the same time combining acceptable ductility and impact strength, in the as-rolled condition. Because the finishing temperature is higher in the specimens of this Example than in Example I, the yield and tensile strengths decreased somewhat. However, by the performance of at least 35% reduction on the intermediate section, the tensile strength was kept at 85,000 psi. and higher. Less total reduction would probably not achieve these results.

The metallographic structure of the alloys when viewed parallel to the rolling direction and perpendicular to the plate surface, was found to be an unbanded mixture of ferrite, fine pearlite and some patches of bainite, with the banding of pearlite unexpectedly broken up into smaller dispersed patches. The ferrite, pearlite and bainite are not elongated in the rolling direction. The grain size was greater than ASTM Number 7, making it fine grained. As is well known, an unbanded structure would improve transverse properties, especially ductility and impact properties of the alloy.

While the alloys of this invention were disclosed as plate product, other types of metal articles can be manufactured according to the invention without departing from the spirit and scope thereof.

I claim:

1. A process for producing low carbon high yield strength steel alloy plate characterized in the as-rolled condition by an unbanded microstructure of ferrite, pearlite, and lower transformation products and a minimum yield strength of 75,000 psi., comprising the steps of:

(a) providing a slab consisting essentially by weight of:

| | Percent, about |
|---|---|
| Carbon | .04–.07 |
| Manganese | 1.00–1.60 |
| Sulfur | .015 max. |
| Columbium | .10 max. |
| Boron | .0005–.004 |
| Silicon | .40 max. |
| Aluminum | .02 min. |

and the balance iron with residual impurities;

(b) austenitizing said slab at a temperature between 2200° F. and 2300° F.;

(c) rolling said slab to an intermediate section before the temperature of said intermediate section reaches about 1650° F.;

(d) commencing rolling said intermediate section to final gage while the temperature of said intermediate section is below about 1650° F.;

(e) continuing rolling said intermediate section in the $Ar_3$–$Ar_1$ temperature range in a plurality of small reduction passes while maintaining conditions such that substantially complete recrystallization of deformed grains takes place after each said reduction pass;

(f) continuing rolling said intermediate section below the $Ar_1$ temperature with a maximum reduction of about 15% and a finishing temperature between 1150° F. and 1100° F.;

(g) providing a minimum total reduction of said intermediate section below 1650° F. of about 50%; and (h) cooling said steel plate to room temperature after completion of the rolling.

2. The invention of claim 1 in which said steel slab contains in addition up to 0.10 weight percent vanadium.

3. The invention of claim 1 in which said steel slab contains in addition up to about 0.03 weight percent titanium.

4. A process for producing low carbon high yield strength steel alloy plate characterized in the as-rolled condition by an unbanded microstructure of ferrite, pearlite, and lower transformation products and a minimum tensile strength of 85,000 psi., comprising the steps of:

(a) providing a slab consisting essentially by weight of:

| | Percent, about |
|---|---|
| Carbon | .04–.07 |
| Manganese | 1.00–1.60 |
| Sulfur | .015 max. |
| Columbium | .10 max. |
| Boron | .0005–.004 |
| Silicon | .40 max. |
| Aluminum | .02 min. |

and the balance iron with residual impurities;

(b) austenitizing said slab at a temperature between 2200° F. and 2300° F.;

(c) rolling said slab to an intermediate section before the temperature of said intermediate section reaches about 1650° F.;

(d) commencing rolling said intermediate section to final gage while the temperature of said intermediate section is below about 1650° F.;

(e) continuing rolling said intermediate section in the $Ar_3$–$Ar_1$ temperature range in a plurality of small reduction passes while maintaining conditions such that substantially complete recrystallization of deformed grains takes place after each said reduction pass;

(f) finishing rolling said intermediate section between the $Ar_3$ and $Ar_1$ temperature with a finishing temperature between 1350° F. and the $Ar_1$ temperature;

(g) providing a minimum total reduction of said intermediate section below 1650° F. of about 35%; and (h) cooling said steel plate to room temperature after completion of the rolling.

5. The invention of claim 4 in which said steel slab contains in addition up to 0.10 weight percent vanadium.

6. The invention of claim 4 in which said steel slab contains in addition up to about 0.03 weight percent titanium.

* * * * *